United States Patent [19]

Johnson et al.

[11] Patent Number: 4,936,511

[45] Date of Patent: Jun. 26, 1990

[54] SPRAY GUN WITH DISPOSABLE LIQUID HANDLING PORTION

[75] Inventors: Dee L. Johnson; Dennis M. Cheesebrow, both of St. Paul, Minn.

[73] Assignee: Minnesota Mining and Manufacturing Company, St. Paul, Minn.

[21] Appl. No.: 276,641

[22] Filed: Nov. 28, 1988

[51] Int. Cl.[5] ..... B05B 7/30

[52] U.S. Cl. ..... 239/346; 239/369; 239/371; 239/390; 239/600; 222/145; 222/541; 222/630

[58] Field of Search ..... 239/309, 310, 311, 315, 239/316, 327, 328, 337, 340, 346, 369, 371, 390, 423, 271, 272; 222/107, 129, 136, 145, 541, 630, 637; 206/219, 222; 383/38; 267/166.1

[56] References Cited

U.S. PATENT DOCUMENTS

| | | | |
|---|---|---|---|
| 2,310,633 | 5/1940 | Heimburger | 299/86 |
| 2,649,298 | 8/1953 | Wulff et al. | 267/166.1 |
| 2,932,385 | 4/1960 | Bollmeier et al. | 206/219 |
| 3,074,544 | 1/1963 | Bollmeier et al. | 206/47 |
| 3,087,606 | 4/1963 | Bollmeier et al. | 206/47 |
| 3,201,047 | 8/1965 | Danberg | 239/328 |
| 3,255,972 | 6/1966 | Hultgren etal. | 239/328 |
| 3,300,042 | 1/1967 | Gordon | 267/166.1 |
| 3,432,104 | 3/1969 | Kaltenbach | 239/328 |
| 3,780,950 | 12/1973 | Brennan | 239/328 |
| 4,637,061 | 1/1987 | Riese | 206/219 |
| 4,776,488 | 10/1988 | Gurzan | 222/81 |
| 4,804,144 | 2/1989 | Denman | 239/390 |

FOREIGN PATENT DOCUMENTS

| | | | |
|---|---|---|---|
| 265588 | 2/1966 | Australia | 206/222 |

*Primary Examiner*—Andres Kashnikow
*Assistant Examiner*—Christopher G. Trainor
*Attorney, Agent, or Firm*—Donald M. Sell; Walter N. Kirn; James D. Christoff

[57] ABSTRACT

A liquid spray gun including (1) a reusable air gun portion including a manually operable valve for controlling air flow; and (2) a disposable container and spray nozzle assembly including a sheet of flexible material having portions attached together and to a central portion of a tube to form a container, a liquid in the chamber, and an a spirating nozzle connected to the tube and adapted to be releasably coupled to the air gun portion so that upon movement of air through the nozzle liquid in the chamber will be entrained in that air and sprayed from the nozzle. The assembly can include a coil comprising a strip disposed in a plurality of wraps about an axis and having a spring temper biasing the strip to an axially extended position to form a tube-like structure, with an end portion of the coil positioned around an end portion of the tube within the bag so that during spraying the tube-like structure will insure that most of the liquid can be dispensed from the chamber.

12 Claims, 2 Drawing Sheets

SPRAY GUN WITH DISPOSABLE LIQUID HANDLING PORTION

TECHNICAL FIELD

The present invention relates to air operated liquid spray guns.

BACKGROUND

Air operated liquid spray guns have typically contained passageways that are difficult to clean except by passing a solvent through the gun. Such spray guns have thus not been practical for use to spray liquids such as two part epoxies that cure and subsequently can not be removed by solvents, or liquids that are not easily removed by solvents, or are only removed by solvents that are extremely expensive or dangerous to use.

DISCLOSURE OF INVENTION

The present invention provides a spray gun with a disposable liquid handling portion that is sufficiently inexpensive that it can be disposed of after use, thus allowing a user to spray liquids that can not, or can not easily, economically or safely be removed from a conventional spray gun, which spray gun is particularly useful for spraying relatively high viscosity liquids such as those above 10,000 centipoise.

According to the present invention there is provided a liquid spray gun comprising (1) a reusable air gun portion including a manually engageable handle, having means defining a through passageway including an inlet portion adapted to be attached to a source of air under pressure and an outlet portion, and a manually operable valve in the through passageway for controlling the flow air through the passageway; and (2) a disposable container and spray nozzle assembly comprising a tube, at least one sheet of tough flexible material having portions attached together and to a central sealing portion of the tube to form a bag like container defining an internal chamber in which liquid is contained with an inlet end portion of the tube within the chamber and an outlet end portion of the tube outside of the chamber. The assembly also includes a nozzle having a liquid inlet port connected to the outlet portion of the tube with the through opening in the tube communicating with the liquid inlet port, an air inlet port releasably coupled to the outlet portion of the reusable air gun portion, a spray tip portion having an outlet opening, a through opening communicating between the outlet opening and the liquid and air inlet ports, and venturi means for forming a vacuum at the fluid inlet port upon movement of air into the air inlet port and out the outlet opening in the nozzle so that atmospheric pressure will bias liquid in the chamber into the inlet port to be entrained in air passing out of the outlet opening of the nozzle.

The chamber defined by the sheet may be undivided, and the inlet end portion of the tube may extend toward the end of the chamber opposite its inlet end portion to insure that most of the liquid within the chamber can be dispensed through the spray gun. Alternatively, the sheet or sheets forming the chamber can be attached together along one or more transverse lines of temporary attachment (as is taught in U. S. Pat. No. 2,932,385, incorporated herein by reference) to separate the chamber into parts with the inlet end portion of the tube positioned in one part of the chamber and disposed generally at a right angle to the adjacent temporary attachment line and components of the liquid separated in different parts of the chamber. The assembly can then include a novel coil comprising a strip disposed in a plurality of wraps about an axis and having a spring temper biasing the strip to an axially extended position with successive wraps of the strip material having opposite edge portions overlapping to form a tube like structure, with an end portion of the coil positioned around the inlet end portion of the tube and the coil retained by the temporary attachment line in one part of the chamber with the wraps overlying each other. The temporary attachment line(s) can then be manually separated to afford movement of the coil to its axially extended position extending toward the end of the chamber opposite the tube so that during spraying it will insure that most of the liquid can be dispensed from the chamber.

As another alternative, the novel coil can be used when the chamber defined by the sheet is undivided so that the coil extends toward the end of the chamber opposite the tube, and the sheet of material can have pleats along lines extending generally at right angles to the axis of the coil to afford, under the influence of atmospheric pressure as liquid is dispensed from the chamber, shortening of the chamber in a direction parallel to the axis by folding of the sheet of material along the pleats and movement of the coils against the bias of the spring temper toward a position with the coils overlying each other.

BRIEF DESCRIPTION OF DRAWING

The present invention will be further described with reference to the accompanying drawing wherein like reference numerals refer to like parts in the several views, and wherein.

DETAILED DESCRIPTION

Figure 1:
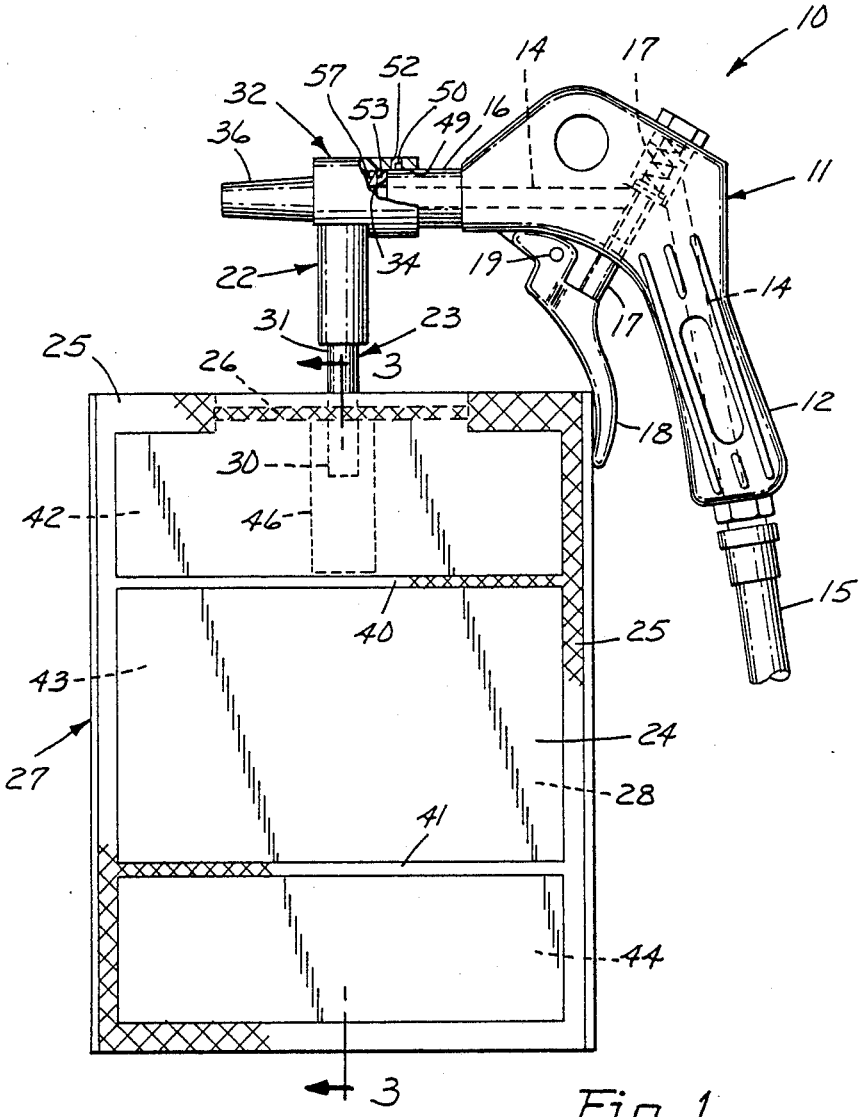
FIG. 1 is a side view of a spray gun according to the present invention attached to a fragment of an air supply hose and having parts broken away to show details.
Figure 2:
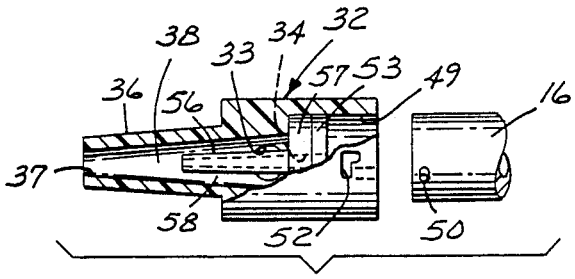
FIG. 2 is a fragmentary top view of the spray gun of FIG. 1 showing a reusable air gun portion separated from a disposable spray nozzle and having parts broken away to show details.

Referring now to the drawing, there is shown a spray gun according to the present invention generally designated by the reference numeral 10.

As illustrated in FIGS. 1, 2, 3 and 4, the spray gun 10 comprises (1) a reusable air gun portion 11 including a manually engageable handle 12, having means defining a through passageway 14 including an inlet portion adapted to be attached as by a threaded coupling and a hose 15 to a source of air under greater than atmospheric pressure and an outlet portion 16, and manually operable valve means in the form of an air valve assembly 17 in the through passageway 14 and manually operable by a trigger 18 pivotably mounted on the handle 12 at a pin 19 for controlling the flow air through the passageway 14; and (2) a disposable container and spray nozzle assembly 22. The disposable container and spray nozzle assembly 22 includes a bag like container 27 comprising a tube 23, and at least one sheet 24 of tough flexible material having edge portions 25 attached together and to a central sealing portion 26 of the tube 23 that has in transverse section a generally elongated diamond shape to form the container 27 and define an internal chamber 28 in which liquid is contained with an inlet end portion 30 of the tube 23 within the chamber 28 and an outlet end portion 31 of the tube 23 outside of the chamber 28. Preferably the tube has an inner diameter of at least 0.63 centimeter to afford passage of high viscosity liquids such as liquids having viscosities of 10,000 centipoise or greater. Also included in the assembly 22 is an aspirating nozzle 32 having a liquid inlet port 33 connected to the outlet end portion 31 of the tube 23 with the through opening in the tube 23 communicating with the liquid inlet port 33, an air inlet port 34 releasably coupled to the outlet portion 16 of the reusable air gun portion 11, a spray tip portion 36 having an outlet opening 37, a through passageway 38 communicating with the outlet opening 37 and liquid and air inlet ports 33 and 34, and means for forming a vacuum at the liquid inlet port 33 upon movement of air into the air inlet port 34 and out the outlet opening 37 in the spray tip portion 36 so that atmospheric pressure will bias liquid in the chamber 28 into the liquid inlet port 33 to be entrained in air passing out of the outlet opening 37 in the spray tip portion 36.

Figure 3:
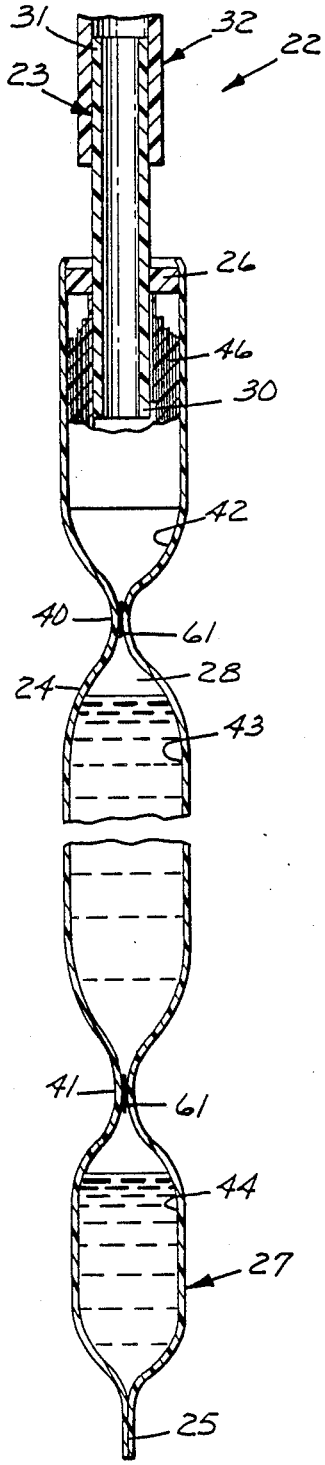
FIG. 3 is a sectional view taken approximately along line 3—3 of FIG. 1.
Figure 4:
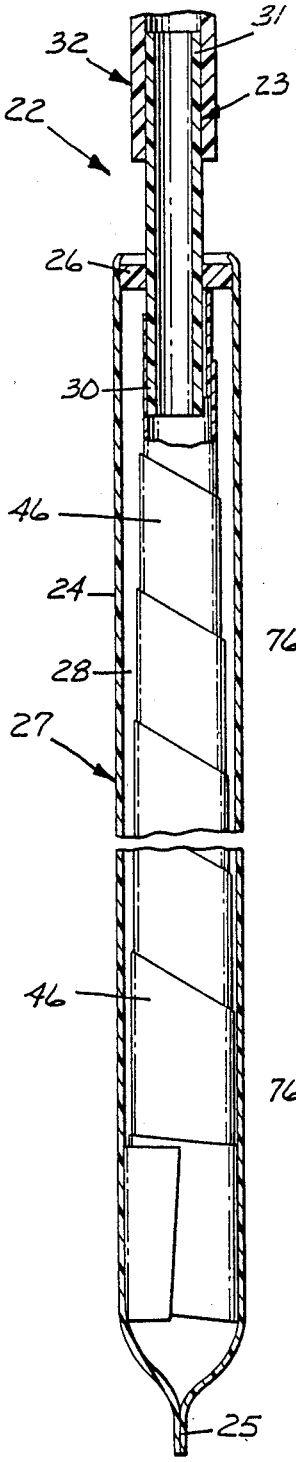
FIG. 4 is a view similar to that of FIG. 3 in which temporary seals have been broken to afford extension of a novel coil included in the spray gun.

The chamber 28 defined by the sheet 24 could be undivided, and the inlet end portion 30 of the tube 23 could be much longer than illustrated and extend toward the end of the chamber 28 opposite its inlet end portion 30 to insure that most of the liquid within the chamber 28 can be dispensed through the spray gun 10. As illustrated, however, as is particularly useful for spraying liquids comprising two components that react with each other and solidify in a short time, opposed portions of the sheet 24 can be attached together along first and second transverse lines 40 and 41 of temporary attachment as taught in U.S. Pat. No. 2,932,385 to separate the chamber 28 into first, second and third parts 42, 43, and 44 respectively, with one component of the liquid being contained in the second part 43 of the chamber 28, another component in the third part 44 of the chamber 28, and the inlet end portion 30 of the tube 23 positioned in the first part 42 of the chamber 28 and disposed generally at a right angle to the temporary attachment lines 40 and 42; and the assembly 22 can include a dip tubing means such as a novel coil 46 comprising a strip disposed in a plurality of wraps about an axis and having a spring temper biasing the strip to an axially extended position (FIG. 4) with successive wraps of the strip having opposite edge portions overlapping to form a tube like structure. The end of the innermost wrap of the coil 46 is attached axially along the inlet end portion 30 of the tube 23 with the axis of the coil 46 generally aligned with the inlet end portion 30 of the tube 23 and, as is illustrated in FIG. 3, the coil 46 is retained in the first part 42 of the chamber 28 with the wraps overlying each other by the first temporary attachment line 40. The second temporary attachment line 41 can then be manually separated just prior to spraying to afford mixing the first and second components of the liquid by kneading the container 27, and the first temporary attachment line 40 can them be manually separated to afford movement of the coil 46 under the influence of its spring bias to its axially extended position extending toward the end of the chamber 28 opposite the tube 23 so that during spraying the coil 46 will restrict collapse of the container and insure that most of the liquid can be sucked from the chamber 28 through the extended coil 46. Preferably the second temporary attachment line 41 is separated first so that the first and second components of the liquid can be mixed without the coil 46 being extended, and then the first temporary attachment line 40 is separated so that the coil 46 moves to its extended position through the mixed liquid.

The air inlet port 34 is releasably coupled to the outlet portion 16 of the reusable air gun portion 11 by the nozzle 32 having a cylindrical socket 49 adapted to receive a distal part of the cylindrical outlet portion 16 with a pin 50 projecting radially of the outlet portion 16 received in a generally L-shaped groove 52 in the wall defining the socket 49. Upon insertion of the outlet portion 16 into the socket 49 the pin 50 moves along an axially extending portion of the groove 52, whereupon the nozzle 32 and air gun portion 11 are rotated about their axes relative to each other so that the pin moves along a circumferentially extending portion of the groove 52 having a wall that cams the end of the outlet portion 16 into sealing engagement with a rubber gasket 53 in the socket 49 and provides a detent at the end of such movement to retain the pin 50 at the end of the groove 52 until a significant amount of force is applied to again rotate the nozzle 32 and air gun portion 11 relative to each other to separate them.

The means for forming a vacuum at the liquid inlet port 33 upon movement of air into the air inlet port 34 and out the outlet opening 37 in the spray tip portion 36 so that atmospheric pressure will bias liquid in the chamber 28 into the liquid inlet port 33 to be entrained in air passing out of the outlet opening 37 in the spray tip portion 36 comprises a venturi structure within the aspirating nozzle 32. The venturi structure is provided by a hollow cylindrical tube 56 (e.g., 0.376 centimeter inside diameter and an outside diameter tapered from 0.467 to 0.3 centimeter) projecting (e.g., 2.14 centimeters) from a cylindrical disc 57 coaxially received in the inner end of the socket 49, which disc 57 defines at its center the air inlet port 34 which communicates with and is the same size as the central opening in the tube 56. The tube 56 projects centrally into a chamber 58 with which the liquid inlet port 33 communicates, which chamber 58 diverges smoothly and concentrically to the outlet opening 37 (e.g., a chamber 58 diverging from a diameter of 0.91 centimeter around the base of the tube 56 to a diameter of 0.52 centimeter at the outlet opening 37 over a length of 4.13 centimeters) in the spray tip portion 36 of the nozzle 32.

The sheet 24 of tough flexible material from which the container 27 is made is preferably of a laminated material including layers of polyester, aluminum and low density polyethylene such as that material commercially available from Ludlow Corporation, Lombard, Ill., and identified as a laminate of "48 gauge polyester 0.8 #/1000 sq. ft. W-01-978 thermosetting adhesive ×0.00035 aluminum type 1145×0.8 #/1000 sq. ft. W-01-978 thermosetting adhesive ×0.003 linear low density, polyethylene (1151B) (0.910–0.925)". The low density polyethylene layer is fused together to form the edge portions 25 and to the central portion 26 of the tube (which is made of Delrin (t.m.)) to form the chamber 28, and the low density polyethylene layer is heat sealed to both surfaces of a layer 61 of thin porous paper coated on both surfaces with a thin continuous layer of polyethylene to form the temporary transverse lines 40 and 41 that separate the chamber 28 into the parts 42, 43, and 44, and are manually separable to afford mixing of the liquid and extension of the coil 46.

The coil 46 is preferably made from a strip of polyester that is 1.1 inches wide, 24 inches long, and 0.01 inch thick. The strip is wound into a coil having an inside diameter of 0.38 inch and an outside diameter of 0.7 inch, axially extended to an overall length of about 10.5 inch and heat set at about 115 degrees centigrade (240 degrees Fahrenheit) for about 4 minutes so that it has a spring temper biasing it to that extended form.

The reusable air gun portion 11 can be made by cutting the end portion including the dip tube from a commercially available spray gun available from Minnesota Mining and Manufacturing Company, St. Paul, Minn. under the trade designation "Body Schutz Applicator Gun", Part No. 08997.

Preferably the spray gun 10 also includes means for relieving pressure that could develop in the liquid inlet port 33 should the outlet opening in the spray tip portion become plugged. That means for relieving pressure may be in the form of a frictional connection between the outlet end portion 31 of the tube and the liquid inlet port 33 of the nozzle 32 that will separate at a predetermined pressure that is less than a pressure required to rupture the container 27, or a diaphragm (not shown) in the nozzle 32 or container 27 that will rupture at such a predetermined pressure.

A container 27 of the preferred type described above had part 44 of the chamber 28 filled with 32 milliliters of "Parte A" of a 2 part urethane automobile coating (i.e., the coating being formed from 08660 Parte A and 08660 Parte B, commercially available from 3M Italia SPA, P.0. Box 10411-10412, 20110 Milano, Italy), and had part 43 of the chamber 28 filled with 180 milliliters of "Parte B" of the coating. The second temporary seal line 41 was then broken, and the container 27 was kneaded for about 30 seconds to mix the parts of the coating together. The first temporary seal line 40 was then broken, which allowed the coil 46 to move under the influence of its spring bias to its axially extended position extending toward the end of the chamber 28 opposite the tube 23. Using the nozzle 32 and air gun portion 11 described above attached to a source of air pressure of 4 bars (60 pounds per square inch), the mixed liquid in the chamber 28 was then sprayed onto a phosphate treated cold rolled steel 4 inch by 12 inch panel from a distance of 6 to 12 inches away. Visual observations were made of the cure, delivery rate, completeness of evacuation of the liquid from the chamber 28, and spraying characteristics. The coating cured satisfactorily, the delivery rate was similar to state of the art spraying methods, there was no spattering during spraying, and about 75 to 80 percent of the liquid was removed from the chamber 28. Also, by varying the distance between the nozzle 32 and the panel, and/or varying the air pressure to the spray gun 10, different coating textures were achieved. Additionally, the spray gun described above may be used to spray adhesive compositions such as those sold by Minnesota Mining and Manufacturing Co., St. Paul, Minn. in aerosol containers under the trade designations and trademarks "Spray-Mount", "Photo Mount", "Super 77 Spray Adhesive", "75 Repositionable Adhesive", "Super 74 Foam Fast Adhesive" and "80 Rubber & Vinyl Adhesive" in which compositions the aerosol propellant was replaced by pentane. In each case, good results were obtained when spraying such compositions of adhesives at a percent solids that were at least as high as the percent solids of that adhesive in propellant as sold in the aerosol containers.

Figure 5:
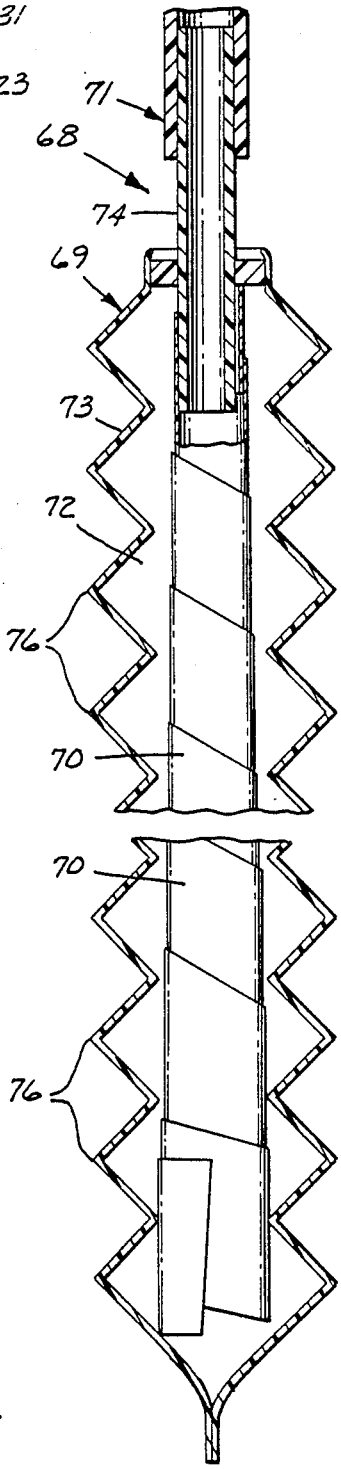
FIG. 5 is an alternate embodiment of a disposable container and spray nozzle assembly that can be included in a spray gun according to the present invention.

FIG. 5 illustrates an alternate embodiment of a disposable container and spray nozzle assembly 68 that can be included in a spray gun according to the present invention and comprises a container 69 including a novel coil 70 having the same structure as the coil 46 described above, which assembly 68 can be used as an alternative for the assembly 22 to spray certain types of liquids through an aspirating nozzle 71 having the same structure as the nozzle 32 described above. The container 69 has a chamber 72 defined by a sheet 73 that is undivided so that the coil 70 extends toward the end of the chamber 72 opposite a tube 74, and the sheet 73 of material has pleats 76 along lines extending generally at right angles to the axis of the coil 70 to afford, under the influence of atmospheric pressure as liquid is sucked or dispensed from the chamber 72, shortening of the chamber 72 in a direction parallel to the axis by folding of the sheet 73 of material along the pleats 76 and movement of the coil 70 against the bias of its spring temper toward a position with the wraps of the coil 70 overlying each other.

The present invention has now been described with reference to several embodiments and modifications thereof. It will be apparent to those skilled in the art that many changes can be made in the embodiments and modifications described without departing from the scope of the present invention. For example, a coil 46 or 70 of the type illustrated could be used in a container generally of the type described in U.S. Pat. No. 4,492,313 (the content whereof is incorporated herein by reference) to provide a container assembly in which a flexible wall defines a chamber having an axis and an opening along the axis, which wall has pleats along lines extending generally at right angles to its axis to afford varying the axial length of the chamber by folding of the wall along the pleats in the manner of a bellows; means attached to the wall over the opening and having an inlet opening communicating with the chamber adapted for affording withdrawing liquid from the chamber through the inlet opening; and the coil with an end portion of the coil positioned around the inlet opening and the coil extending toward the end of the chamber opposite the inlet opening, the length of the tube like structure formed by the extended coil being variable with the axial length of the chamber so that the tube like structure can provide a conduit for liquid from the bottom of the chamber to the outlet opening. Thus, for example, the tube like structure provided by the coil could provide a conduit for liquid in the container to a spray nozzle attached on top of the container that could be an aspirating nozzle of the type described above, or a nozzle through which liquid is pumped by a manually operated pump attached on the top of the container. Thus the scope of the present invention should not be limited to the structures described in this application, but only by structures described by the language of the claims and the equivalents of those structures.

We claim:

1. A disposable container and spray nozzle assembly for spraying liquid onto a surface when the assembly is attached to a source of air under greater than atmospheric pressure, said assembly comprising:

a tube having a through opening, an outlet end portion, an inlet end portion, and a sealing portion between said inlet and outlet end portions, at least one sheet of tough flexible material having portions attached together and to said sealing portion of said tube to form a bag like container defining an internal chamber with the inlet end portion of said tube within said chamber and the outlet end portion of said tube outside of said chamber, said sheet including opposed portions attached together along a manually separable line of temporary attachment to separate said chamber into first and second parts, said first part being spaced from said inlet end portion of said tube, and said line of temporary attachment separating the liquid to be sprayed from communication with the inlet end portion of said tube, a liquid in said chamber, a nozzle having a liquid inlet port connected to said outlet portion of said tube with said through opening in said tube communicating with said liquid inlet port, and air inlet port adapted to be coupled to the source of air under pressure, a spray tip portion having an outlet opening, a through opening communicating between said outlet opening and said liquid and air inlet ports, and means for forming a vacuum at the liquid inlet port upon movement of air into said air inlet port and out said outlet opening in said spray top portion so that atmospheric pressure will bias liquid in said chamber into said liquid inlet port to be entrained in air passing through said through opening and out of said outlet opening.

2. The assembly according to claim 1, including dip tubing means that is movable in said chamber past said opposed portions subsequent to separation of said line of temporary attachment.

3. A disposable container and spray nozzle assembly for spraying liquid onto a surface when the assembly is attached to a source of air under greater than atmospheric pressure, said assembly comprising:

a tube having a through opening, an outlet end portion, an inlet end portion, and a sealing portion between said inlet and outlet end portions, at least one sheet of tough flexible material having portions attached together and to said sealing portion of said tube to form a bag like container defining an internal chamber with the inlet end portion of said tube within said chamber and the outlet end portion of said tube outside of said chamber, a liquid in said chamber, a nozzle having a liquid inlet port connected to said outlet portion of said tube with said through opening in said tube communicating with said liquid inlet port, and air inlet port adapted to be coupled to the source of air under pressure, a spray tip portion having an outlet opening, a through opening communicating between said outlet opening and said liquid and air inlet ports, and means for forming a vacuum at the liquid inlet port upon movement of air into said air inlet port and out said outlet opening in said spray tip portion so that atmospheric pressure will bias liquid in said chamber into said liquid inlet port to be entrained in air passing through said through opening and out of said outlet opening, wherein portions of said sheet are attached together along a first transverse line of temporary attachment to separate said chamber into first and second parts, said inlet end portion of said tube is positioned in said first part of said chamber and disposed generally at a right angle to said temporary attachment line, and said assembly includes a coil comprising a strip disposed in a plurality of wraps about an axis and having a spring temper biasing said strip to an axially extended position with successive wraps of said strip material having opposite edge portions overlapping to form a tube like structure, said coil being positioned around the inlet end portion of the tube and being retained in said first part of said chamber with said wraps overlying each other by said temporary attachment line, said temporary attachment line being manually separable to afford movement of said coil to said axially extended position extending from said tube toward the end of said chamber opposite said tube.

4. A disposable container and spray nozzle assembly for spraying liquid onto a surface when the assembly is attached to a source of air under greater than atmospheric pressure, said assembly comprising:

a tube having a through opening, an outlet end portion, an inlet end portion, and a sealing portion between said inlet and outlet end portions, at least one sheet of tough flexible material having portions attached together and to said sealing portion of said tube to form a bag like container defining an internal chamber with the inlet end portion of said tube within said chamber and the outlet end portion of said tube outside of said chamber, a liquid in said chamber, a nozzle having a liquid inlet port connected to said outlet portion of said tube with said through opening in said tube communicating with said liquid inlet port, and air inlet port adapted to be coupled to the source of air under pressure, a spray tip portion having an outlet opening, a through opening communicating between said outlet opening and said liquid and air inlet ports, and means for forming a vacuum at the liquid inlet port upon movement of air into said air inlet port and out said outlet opening in said spray tip portion so that atmospheric pressure will bias liquid in said chamber into said liquid inlet port to be entrained in air passing through said through opening and out of said outlet opening, wherein portions of said sheet are attached together along first and second transverse lines of temporary attachment to separate said chamber into first, second and third parts, said liquid to be sprayed comprises a first component in the second part of said chamber and a second component in the third part of said chamber, said inlet end portion of said tube is positioned in said first part of said chamber and disposed generally at a right angle to said temporary attachment lines, and said assembly includes a coil comprising a strip disposed in a plurality of wraps about an axis and having a spring temper biasing said strip to an axially extended position with successive wraps of said strip material having opposite edge portions overlapping to form a tube like structure, said coil being positioned around said inlet end portion of said tube and being retained in said first part of said chamber with said wraps overlying each other by said first temporary attachment line, said first and second temporary attachment lines being manually separable to afford mixing the first and second components of said liquid and movement of said coil to said axially extended position extending from said tube toward the end of said chamber opposite said tube.

5. A disposable container and spray nozzle assembly for spraying liquid onto a surface when the assembly is attached to a source of air under greater than atmospheric pressure, said assembly comprising:

a tube having a through opening, an outlet end portion, an inlet end portion, and a sealing portion between said inlet and outlet end portions, at least one sheet of tough flexible material having portions attached together and to said sealing portion of said tube to form a bag like container defining an internal chamber with the inlet end portion of said tube within said chamber and the outlet end portion of said tube outside of said chamber, a liquid in said chamber, a nozzle having a liquid inlet port connected to said outlet portion of said tube with said through opening in said tube communicating with said liquid inlet port, and air inlet port adapted to be coupled to the source of air under pressure, a spray tip portion having an outlet opening, a through opening communicating between said outlet opening and said liquid and air inlet ports, and means for forming a vacuum at the liquid inlet port upon movement of air into said air inlet port and out said outlet opening in said spray tip portion so that atmospheric pressure will bias liquid in said chamber into said liquid inlet port to be entrained in air passing through said through opening and out of said outlet opening, further including a coil comprising a strip disposed in a plurality of wraps about an axis and having a spring temper biasing said strip to an axially extended position with successive wraps of said strip material having opposite edge portions overlapping to form a tube like structure, said coil being positioned around said inlet end portion of said tube with the axis of said coil generally aligned with the inlet end portion of the tube and said coil extending toward the end of said chamber opposite said tube, and wherein said sheet of material has pleats along lines extending generally at right angles to said axis to afford, under the influence of atmospheric pressure, shortening of said chamber in a direction parallel to said axis by folding of said sheet of material along said pleats and movement of said coils against the bias of said spring temper toward a position with said coils overlying each other.

6. A disposable container for liquid comprising:

a tube having a through opening, an outlet end portion, an inlet end portion, and a sealing portion between said inlet and outlet end portions, at least one sheet of tough flexible material having portions attached together and to said sealing portion of said tube to form a bag like container defining an internal chamber with the inlet end portion of said tube within said chamber and the outlet end portion of said tube outside of said chamber, a liquid in said chamber, and a coil comprising a strip disposed in a plurality of wraps about an axis and having a spring temper biasing said strip to an axially extended position with successive wraps of said strip material having opposite edge portions overlapping to form a tube like structure, at least one end portion of said coil being positioned around said inlet end portion of said tube.

7. A disposable container according to claim 6 wherein portions of said sheet are also temporarily attached together along first and second transverse lines of temporary attachment so that said chamber is separated into first, second and third parts, said inlet end portion of said tube is positioned in said first part of said chamber and disposed generally at a right angle to said first temporary attachment line, said coil is positioned around said inlet end portion of said tube and is retained in said first part of said chamber against the bias of said spring temper with said wraps overlying each other by said first temporary attachment line, said liquid comprises a first component in the second part of said chamber and a second component in the third part of said chamber, said second temporary attachment line is manually separable to afford mixing the first and second components of said liquid, and said first temporary attachment line is manually separable to afford movement of said coil to said axially extended position extending from said tube toward the end of said chamber opposite said tube.

8. A disposable container according to claim 6 wherein said coil extends toward the end of said chamber opposite said tube, and said sheet of material has pleats along lines extending generally at right angles to said axis to afford shortening of said chamber in a direction parallel to said axis by folding of said sheet of material along said pleats and movement of said coils against the bias of said spring temper toward a position with said coils overlying each other.

9. A liquid spray gun comprising:

a reusable air gun portion including a manually engageable handle, having means defining a through passageway including an inlet portion adapted to be attached to a source of air under pressure and an outlet portion, and manually operable valve means in said through passageway for controlling the flow air through said passageway; and a disposable container and spray nozzle assembly comprising:

a tube having a through opening, an outlet end portion, an inlet end portion, and a sealing portion between said inlet and outlet end portions, at least one sheet of tough flexible material having portions attached together and to said sealing portion of said tube to form a bag like container defining at least one internal chamber with the inlet end portion of said tube within said chamber and the outlet end portion of said tube outside of said chamber, a liquid in said chamber, and a nozzle having a liquid inlet port connected to said outlet portion of said tube with said through opening in said tube communicating with said liquid inlet port, and air inlet port, a spray tip portion having an outlet opening, a through opening communicating between said outlet opening and said liquid and air inlet ports, and means for forming a vacuum at the liquid inlet port upon movement of air into said air inlet port and out said outlet opening in said spray tip portion so that atmospheric pressure will bias liquid in said chamber into said liquid inlet port to be entrained in air passing through said through opening and out of said outlet opening; and means for releasably coupling said nozzle to said outlet portion of said reusable air gun portion with said through opening communicating with said air inlet port, wherein portions of said sheet are attached together along a first transverse line of temporary attachment to separate said chamber into first and second parts, said inlet end portion of said tube is positioned in said first part of said chamber and disposed generally at a right angle to said temporary attachment line, and said assembly includes a coil comprising a plurality of wraps of strip material about an axis and having a spring temper biasing said strip to an axially extended position with successive wraps of said strip material having opposite edge portions overlapping to form a tube like structure, said innermost wrap of said coil being attached to said inlet end portion of said tube with the axis of said coil generally aligned with the inlet end portion of the tube and said coil being retained in said first part of said chamber with said wraps overlying each other by said temporary attachment line, said temporary attachment line being manually separable to afford movement of said coil to said axially extend position extending toward the end of said chamber opposite said tube.

10. A liquid spray gun comprising:

a reusable air gun portion including a manually engageable handle, having means defining a through passageway including an inlet portion adapted to be attached to a source of air under pressure and an outlet portion, and manually operable valve means in said through passageway for controlling the flow air through said passageway; and a disposable container and spray nozzle assembly comprising:

a tube having a through opening, an outlet end portion, an inlet end portion, and a sealing portion between said inlet and outlet end portions, at least one sheet of tough flexible material having portions attached together and to said sealing portion of said tube to form a bag like container defining at least one internal chamber with the inlet end portion of said tube within said chamber and the outlet end portion of said tube outside of said chamber, a liquid in said chamber, and a nozzle having a liquid inlet port connected to said outlet portion of said tube with said through opening in said tube communicating with said liquid inlet port, and air inlet port, a spray tip portion having an outlet opening, a through opening communicating between said outlet opening and said liquid and air inlet ports, and means for forming a vacuum at the liquid inlet port upon movement of air into said air inlet port and out said outlet opening in said spray tip portion so that atmospheric pressure will bias liquid in said chamber into said liquid inlet port to be entrained in air passing through said through opening and out of said outlet opening; and means for releasably coupling said nozzle to said outlet portion of said reusable air gun portion with said through opening communicating with said air inlet port, wherein portions of said sheet are attached together along first and second transverse lines of temporary attachment to separate said chamber into first, second and third parts, said liquid to be sprayed comprises a first component in the second part of said chamber and a second component in the third part of said chamber, said inlet end portion of said tube is positioned in said first part of said chamber and disposed generally at a right angle to said temporary attachment lines, and said assembly includes a coil comprising a strip disposed in a plurality of wraps about an axis and having a spring temper biasing said strip to an axially extended position with successive wraps of said strip material having opposite edge portions overlapping to form a tube like structure, an end portion of said coil being positioned around said inlet end portion of said tube and said coil being retained in said first part of said chamber with said wraps overlying each other by said first temporary attachment line, said first and second temporary attachment lines being manually separable to afford mixing the first and second components of said liquid and movement of said coil to said axially extended position extending toward the end of said chamber opposite said tube.

11. A liquid spray gun comprising:

a reusable air gun portion including a manually engageable handle, having means defining a through passageway including an inlet portion adapted to be attached to a source of air under pressure and an outlet portion, and manually operable valve means in said through passageway for controlling the flow air through said passageway; and a disposable container and spray nozzle assembly comprising:

a tube having a through opening, an outlet end portion, an inlet end portion, and a sealing portion between said inlet and outlet end portions, at least one sheet of tough flexible material having portions attached together and to said sealing portion of said tube to form a bag like container defining at least one internal chamber with the inlet end portion of said tube within said chamber and the outlet end portion of said tube outside of said chamber, a liquid in said chamber, and a nozzle having a liquid inlet port connected to said outlet portion of said tube with said through opening in said tube communicating with said liquid inlet port, and air inlet port, a spray tip portion having an outlet opening, a through opening communicating between said outlet opening and said liquid and air inlet ports, and means for forming a vacuum at the liquid inlet port upon movement of air into said air inlet port and out said outlet opening in said spray tip portion so that atmospheric pressure will bias liquid in said chamber into said liquid inlet port to be entrained in air passing through said through opening and out of said outlet opening; and means for releasably coupling said nozzle to said outlet portion of said reusable air gun portion with said through opening communicating with said air inlet port, further including a coil comprising a strip disposed in a plurality of wraps about an axis and having a spring temper biasing said strip to an axially extended position with successive wraps of said strip material having opposite edge portions overlapping to form a tube like structure, an end portion of said coil being positioned around said inlet end portion of said tube and said coil extending toward the end of said chamber opposite said tube, and wherein said sheet of material has pleats along lines extending generally at right angles to said axis to afford under the influence of atmospheric pressure shortening of said chamber in a direction parallel to said axis by folding of said sheet of material along said pleats and movement of said coils against the bias of said spring temper toward a position with said coils overlying each other.

12. A container assembly comprising:

a flexible wall defining a chamber having an axis and an opening along said axis, said wall having pleats along lines extending generally at right angles to said axis to afford varying the axial length of said chamber by folding of said wall along said pleats;

means attached to said wall over said opening and having an inlet opening communicating with said chamber adapted for affording withdrawing liquid from said chamber through said inlet opening;

a coil comprising a strip disposed in a plurality of wraps about an axis and having a spring temper biasing said strip to an axially extended position with successive wraps of said strip material having opposite edge portions overlapping to form a tube like structure, an end portion of said coil being positioned around said inlet opening and said coil extending toward the end of said chamber opposite said tube, the length of said tube like structure being variable with the axial length of said chamber so that said tube like structure can provide a conduit for liquid from the bottom of said chamber to said outlet opening.

* * * * *